US007185560B2

(12) United States Patent
Flanagan

(10) Patent No.: US 7,185,560 B2
(45) Date of Patent: Mar. 6, 2007

(54) JAR OPENER

(76) Inventor: Michael P. Flanagan, 10 Filare, Irvine, CA (US) 92620

( * ) Notice: Subject to any disclaimer, the term of this patent is extended or adjusted under 35 U.S.C. 154(b) by 54 days.

(21) Appl. No.: 11/055,302

(22) Filed: Feb. 9, 2005

(65) Prior Publication Data

US 2006/0174728 A1 Aug. 10, 2006

(51) Int. Cl.
*B67B 7/46* (2006.01)
*B67B 7/00* (2006.01)

(52) U.S. Cl. ..... 81/3.32; 81/3.2; 81/3.25

(58) Field of Classification Search ..... 81/3.32, 81/3.2, 3.25, 3.31, 3.39
See application file for complete search history.

(56) References Cited

U.S. PATENT DOCUMENTS 1,689,301 A * 10/1928 Ryckman ..... 30/433
3,795,158 A 3/1974 Morita
4,171,650 A * 10/1979 Cardinal ..... 81/3.2
4,569,281 A * 2/1986 Woods ..... 100/103
4,762,029 A * 8/1988 Chen ..... 81/3.2
4,919,014 A * 4/1990 Chen et al. ..... 81/3.2
5,167,172 A * 12/1992 Heebner ..... 81/3.2
5,430,923 A 7/1995 Parent et al.
5,647,251 A * 7/1997 Hardman ..... 81/3.2
5,996,441 A * 12/1999 Bateman ..... 81/3.2
6,293,170 B1 * 9/2001 Hajianpour ..... 81/3.2

* cited by examiner

*Primary Examiner*—Lee D. Wilson
*Assistant Examiner*—Alvin J. Grant
(74) *Attorney, Agent, or Firm*—James E. Brunton, Esq.

(57) ABSTRACT

The invention provides a novel, easy to use, hand-operated apparatus for effortlessly loosening the threaded lid of ajar or bottle having a screw-on lid and readily accommodates jars or bottles of different sizes. One form of the invention includes a base having a jar supporting surface, a generally vertically extending guide column connected to the base and a carriage assembly connected to the guide for movement relative to the guide between a first raised position and a second lowered position. Novel features of the invention include the provision of a helical drive screw which drives a jar lid engaging assembly and a novel safety clutch mechanism which prevents the exertion of excessive force on the jar being opened.

19 Claims, 7 Drawing Sheets

JAR OPENER

BACKGROUND OF THE INVENTION

1. Field of the Invention

The present invention relates generally to devices for opening sealed containers. More particularly the invention concerns a manually operated apparatus for removing screw-on lids from jars.

2. Description of the Prior Art

Jars and bottles, commonly made of glass and plastic have long been employed to contain and store various types of foods and materials. Typically, such containers are provided with screw-type closure lids, which attach to the jars by cooperating threads. In order to properly seal the container, the lid is generally tightly fitted to its associated jar often making it difficult to remove the lid from the container. Entrapment of small amounts of the contained material within the threads may also contribute to difficulty in loosening the jar lid as will corrosion of the lid with the passage of time. Even under the best of conditions, the very young, the elderly and persons with arthritis and like infirmities often find it extremely difficult to accomplish the task of removing the threaded lid from its associated container.

A wide variety of jar opening devices have been suggested in the past. For example, several container opening devices of the strap wrench type have previously been designed and marketed. Generally these devices include a friction buckle arrangement along with an elongated handle for removing the lid. In other prior art under the counter type devices a cam lock principle is used such as "V" notch and cam-lock for gripping the jar lid. These devices generally require the user to hold the container in position while turning it. When the container is made of glass, breakage of the container is possible, resulting in the possibility of severe lacerations to the hand of the user.

A more sophisticated type of container opening device is described in U.S. Pat. No. 5,430,923 issued to Parent et al. The Parent et al., device includes a mechanical drive for causing relative rotation to occur between the container cap and a cap-engaging unit. The mechanical drive brings the cap unit into engagement with the cap and then slips to permit the cap to be unscrewed from the container. A control unit senses the torque created by the relative rotation between the cap and the cap engaging unit and when a drop in torque is sensed, the control unit causes the drive to move the cap and the cap-engaging unit out of operable engagement.

U.S. Pat. No. 3,795,158 issued to Morita discloses a jar lid remover which comprises a jar base clamp that is adjustable into a clamping relationship with the base of the jar and a jar lid clamp that is adjustably positioned directly above the base clamp for vertical adjustment. The jar lid clamp is power driven in a manner such that the motorized application of lid unscrewing torque increases the extent of the clamping engagement of the clamp means on the lid so as to prevent torsional slipping during the jar lid unscrewing operation.

SUMMARY OF THE INVENTION

By way of summary, one form of the novel jar opening apparatus of the invention for opening a jar having a screw-on lid comprises a base having a jar supporting surface, a generally vertically extending guide column connected to the base and a carriage assembly connected to the guide for movement relative to the guide between a first raised position and a second lowered position. The carriage assembly uniquely comprises a carriage; a lid-engaging assembly operably associated with the carriage for engaging the screw-on lid when the carriage is in the second position, the lid-engaging assembly including a lid-engaging member; and rotating means operably associated with the lid-engaging member for imparting rotation thereto. The rotating means here comprises a helical drive screw connected to the carriage and a cooperating drive disk connected to the lid-engaging member. Operating means are operably associated with the carriage for moving the carriage between the first and second positions. This novel operating means of the invention comprises a handle assembly connected to the carriage for movement between a first elevated position and a second lowered position, the handle assembly including a driving drum for engagement with the vertically extending guide column to move the carriage toward said second position.

With the forgoing in mind, it is an object of the present invention to provide an easy to use, hand-operated apparatus for effortlessly loosening the threaded lid of a jar or bottle.

Another object of the invention is to provide a jar lid removing apparatus of the aforementioned character, which is designed to readily accommodate jars of different sizes.

Another object of the invention is to provide a jar lid removing apparatus, which can be easily and effortlessly operated by persons lacking hand and arm strength, such as the elderly and the infirm.

Another object of the invention to provide a jar lid removing apparatus of the character described in the preceding paragraphs which is of simple construction, is inexpensive to manufacture, is dependable in use and requires minimum maintenance.

Another object of the invention is to provide a jar lid removing apparatus which has a pleasing appearance, can be easily cleaned and takes up a minimum kitchen counter surface area.

These and other objects of the invention will become readily apparent from the discussion, which follows.

DESCRIPTION OF THE INVENTION

Figure 1:
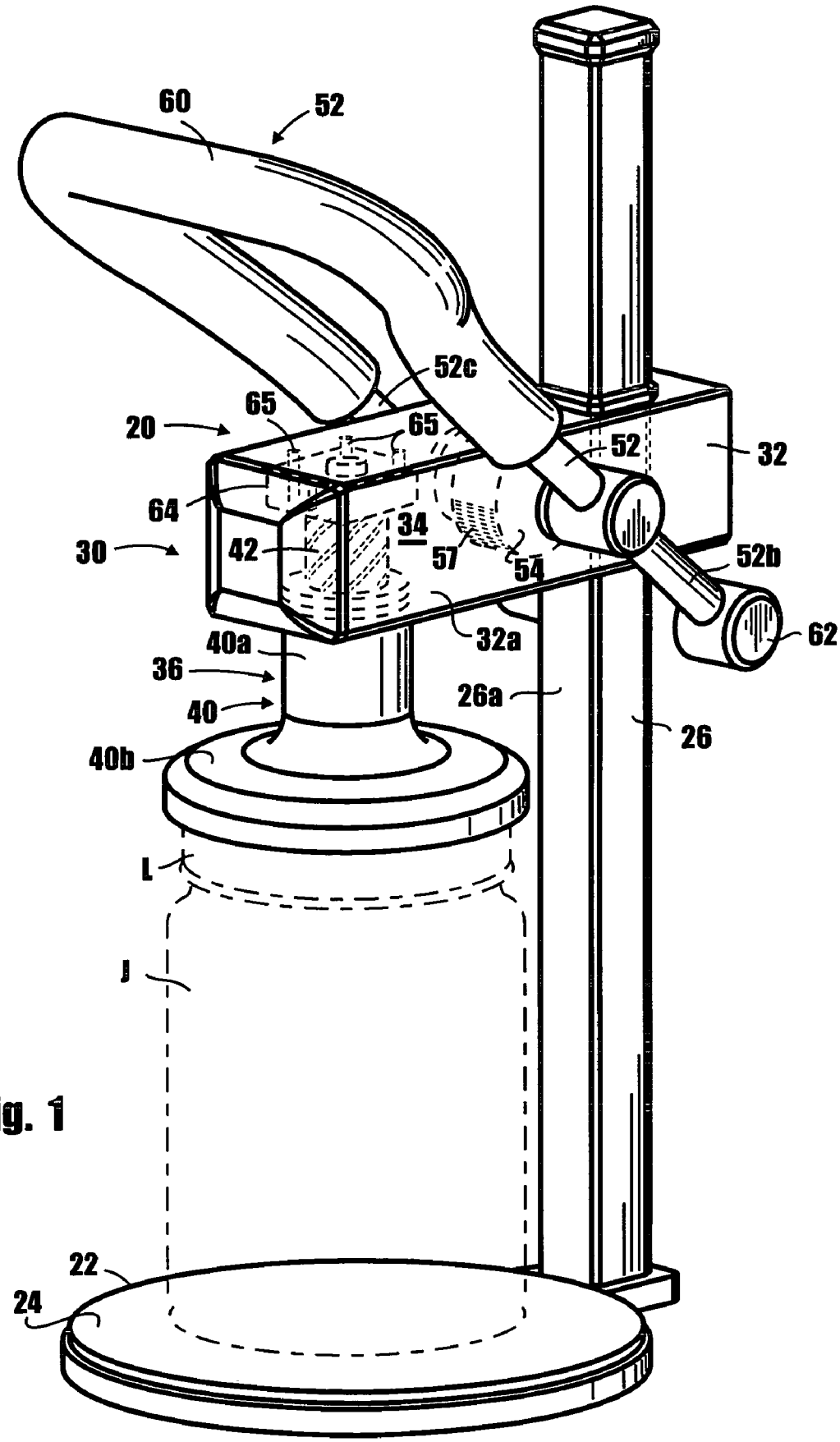
FIG. 1 is a generally perspective view, partly in phantom, to show internal construction of one form of the jar-opening device of the present invention.

Referring to the drawings and particularly to FIGS. 1 through 6, one form of the jar opener apparatus of the invention is there shown and generally designated by the numeral 20. As best seen in FIG. 1, the apparatus here comprises a base 22 having an elastomeric jar supporting and gripping surface 24. Connected to base 22 is a generally vertically extending guide 26. Guide 26 comprises a generally rectangular-shaped, hollow tube having a roller drum engaging surface 26*a*.

Figure 3:
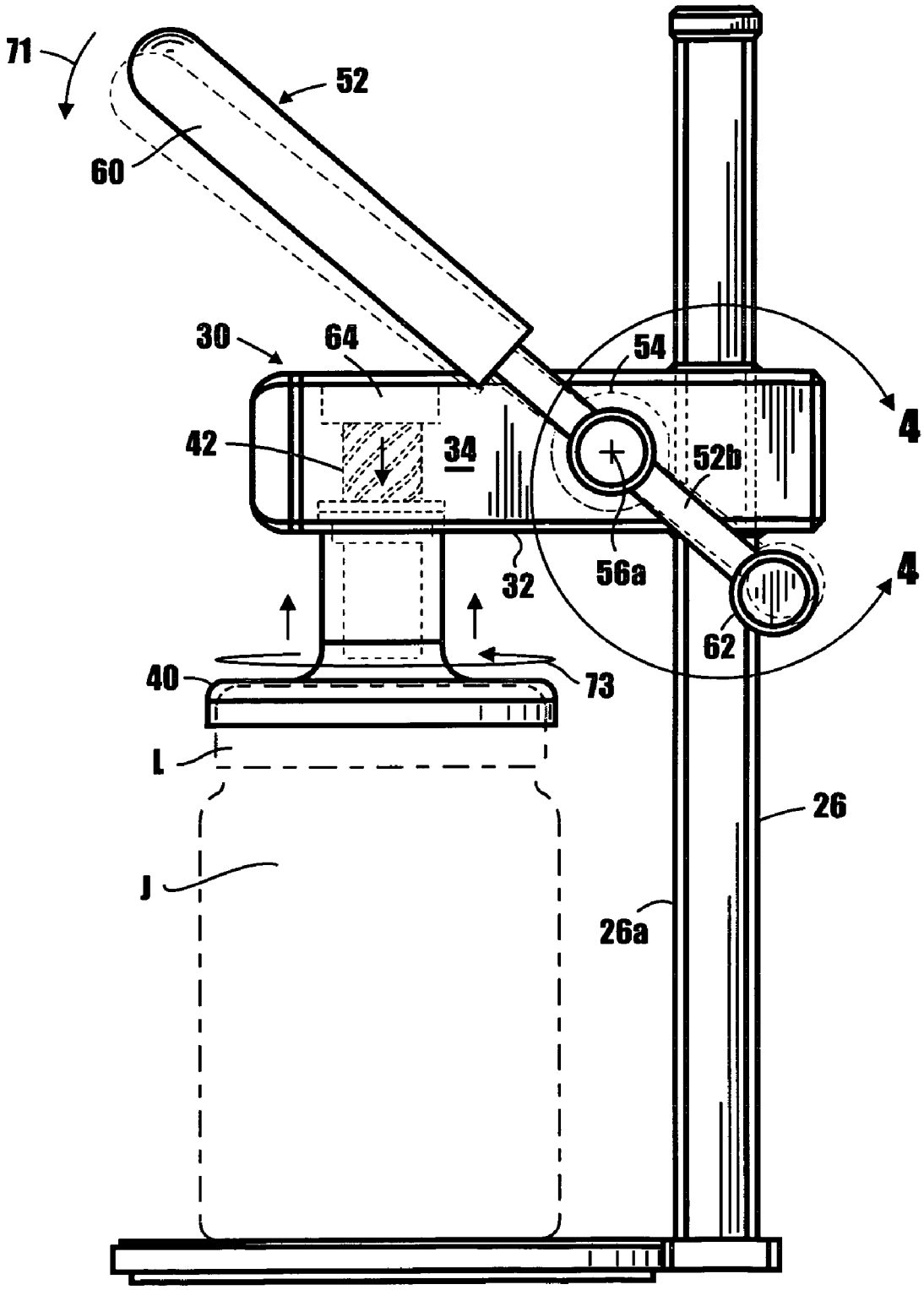
FIG. 3 is a side-elevational view of the jar opening apparatus illustrating the operation of the apparatus to remove ajar lid.

Connected to guide 26 for vertical movement relative thereto between a first position shown in FIG. 1 and a second jar lid opening position, is a carriage assembly generally designated by the numeral 30. Carriage assembly 30 comprises a carriage 32, which includes a hollow housing 32*a* having an interior space 34 (FIGS. 1 and 3).

Figure 6:
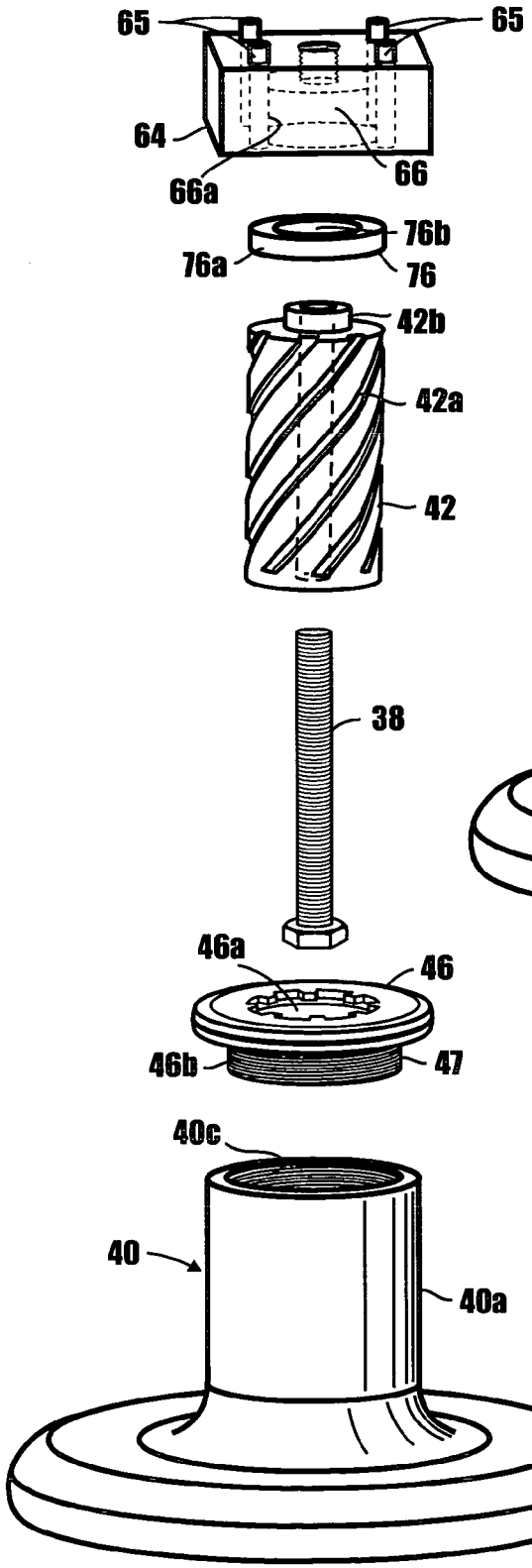
FIG. 6 is a generally perspective, exploded view of the helical drive assembly, the driven disc, a portion of the device carriage and the jar lid-engaging assembly of the apparatus of one form of the invention.
Figure 7:
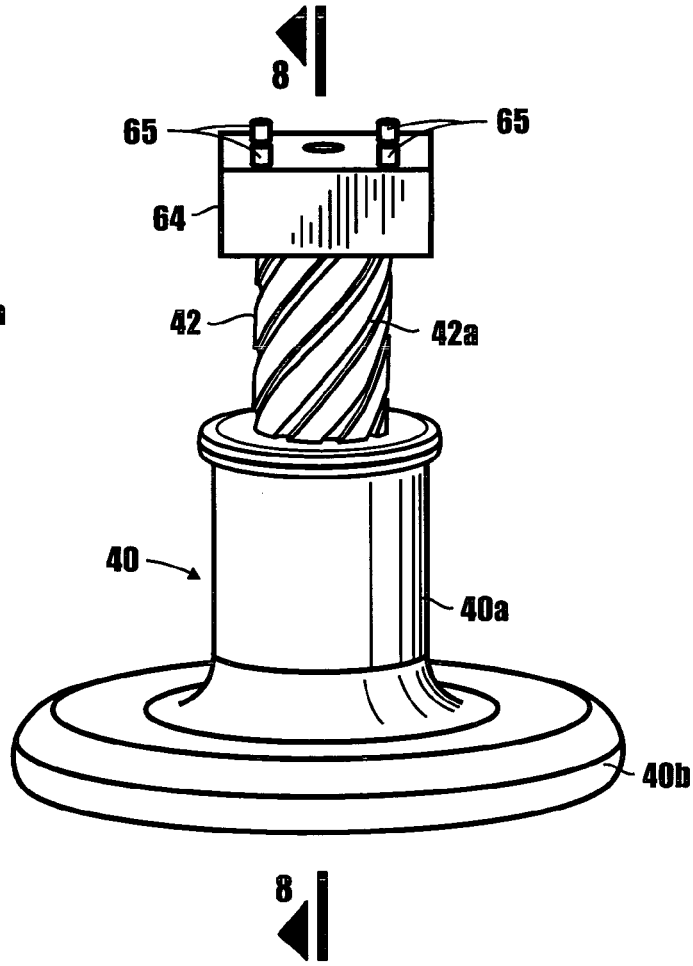
FIG. 7 is a generally perspective view similar to FIGS. 6 but showing the components of FIG. 6 in an assembled configuration.

Operably associated with carriage assembly 30 is a lid-engaging assembly 36 which functions to frictionally engage the screw-on lid "L" of a jar "J" when the carriage is in the second lowered position. As best seen in FIG. 6, lid-engaging assembly 36 here includes a lid-engaging member 40 having a hollow neck portion 40*a* (FIG. 9) and a jar lid-engaging, flange-like portion 40*b* which is adapted to engage lid L.

Figure 8:
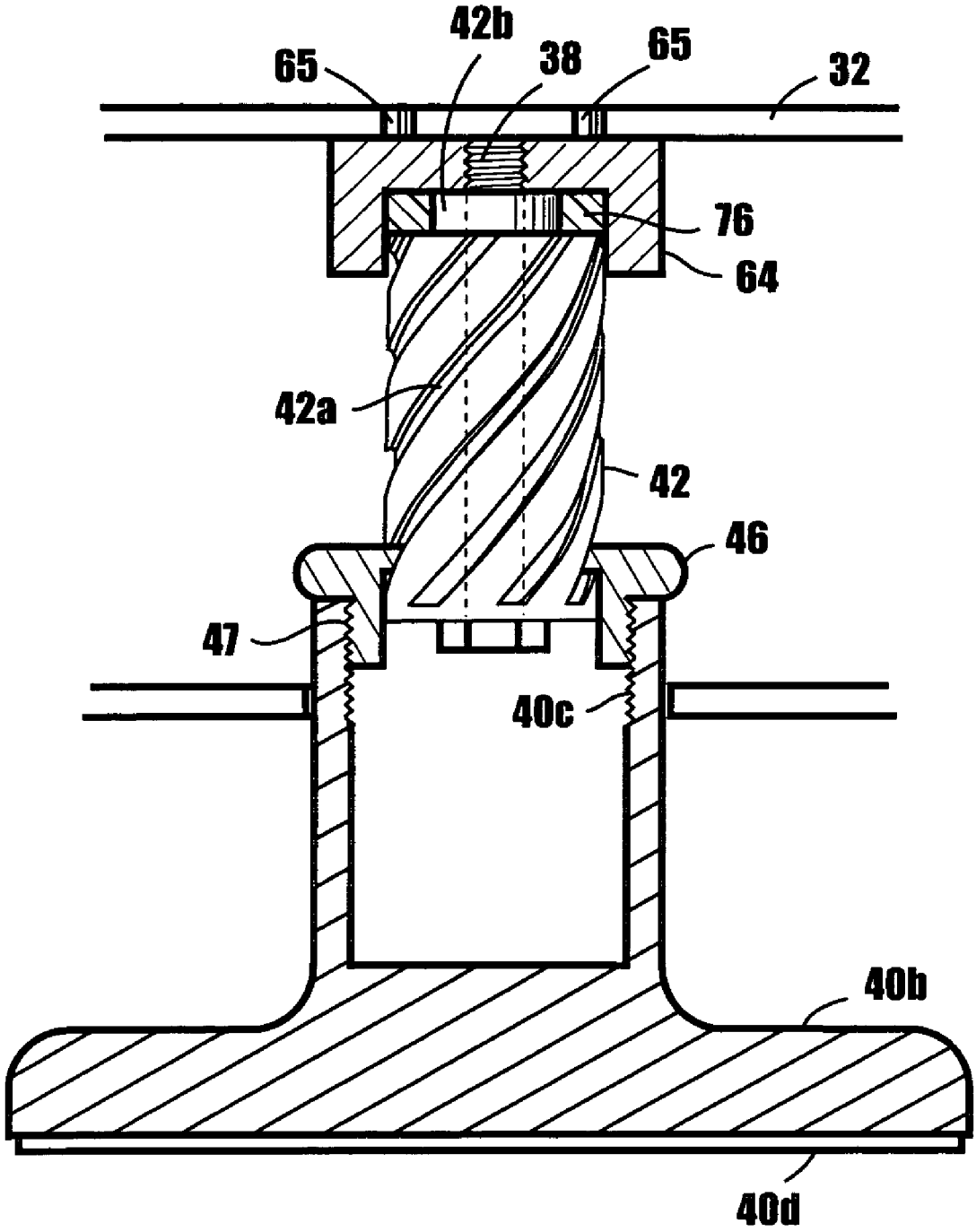
FIG. 8 is a cross-sectional view taken along lines 8—8 of FIG. 7.

In the present form of the invention, novel rotating means are provided for controllably rotating the lid-engaging assembly 36. This important rotating means here comprises a helical drive screw 42, which is connected to carriage 32 by threaded connector 38. As best seen in FIG. 8, helical drive screw 42 is provided with an elongated helical groove 42*a*. Also forming a part of the rotating means of the invention is a disc-like driven member 46 (FIG. 5), which is here threadably connected to lid-engaging member 40 (FIG. 6). More particularly, as shown in FIG. 6, hollow neck portion 40*a* is provided with internal threads 40*c* which threadably receive external threads 46*b* formed on a reduced diameter portion 47 of driven member 46. As will be discussed in greater detail hereinafter, as the carriage assembly is moved into its lowered position by the operating means of the invention, the elastomeric gripping component 40*d* of the lid-engaging member 40 (FIGS. 8 and 9) will be brought into frictional contact with the screw top lid of the jar and the helical drive screw 42 will then impart controlled rotation to driven member 46 and to the lid-engaging member to which it is connected so as to expeditiously loosen the lid. In this regard, it is to be noted that driven disk 46 has a central aperture 46*a* which is provided with a plurality of circumferentially spaced-apart driven teeth 68 which are receivable within the helical groove 42*a* of helical drive screw 46 in the manner shown in FIGS. 8 and 9.

The important operating means of the invention, the character of which will next be described, is operably associated with carriage assembly 32 and functions to controllably move the carriage assembly between the first and second positions. In the present form of the invention, the operating means comprises a handle assembly 52 which is pivotally connected to carriage 32 for movement between a first position shown by the solid lines in FIG. 3 and a second position shown by the dotted lines in FIG. 3.

Figure 2:
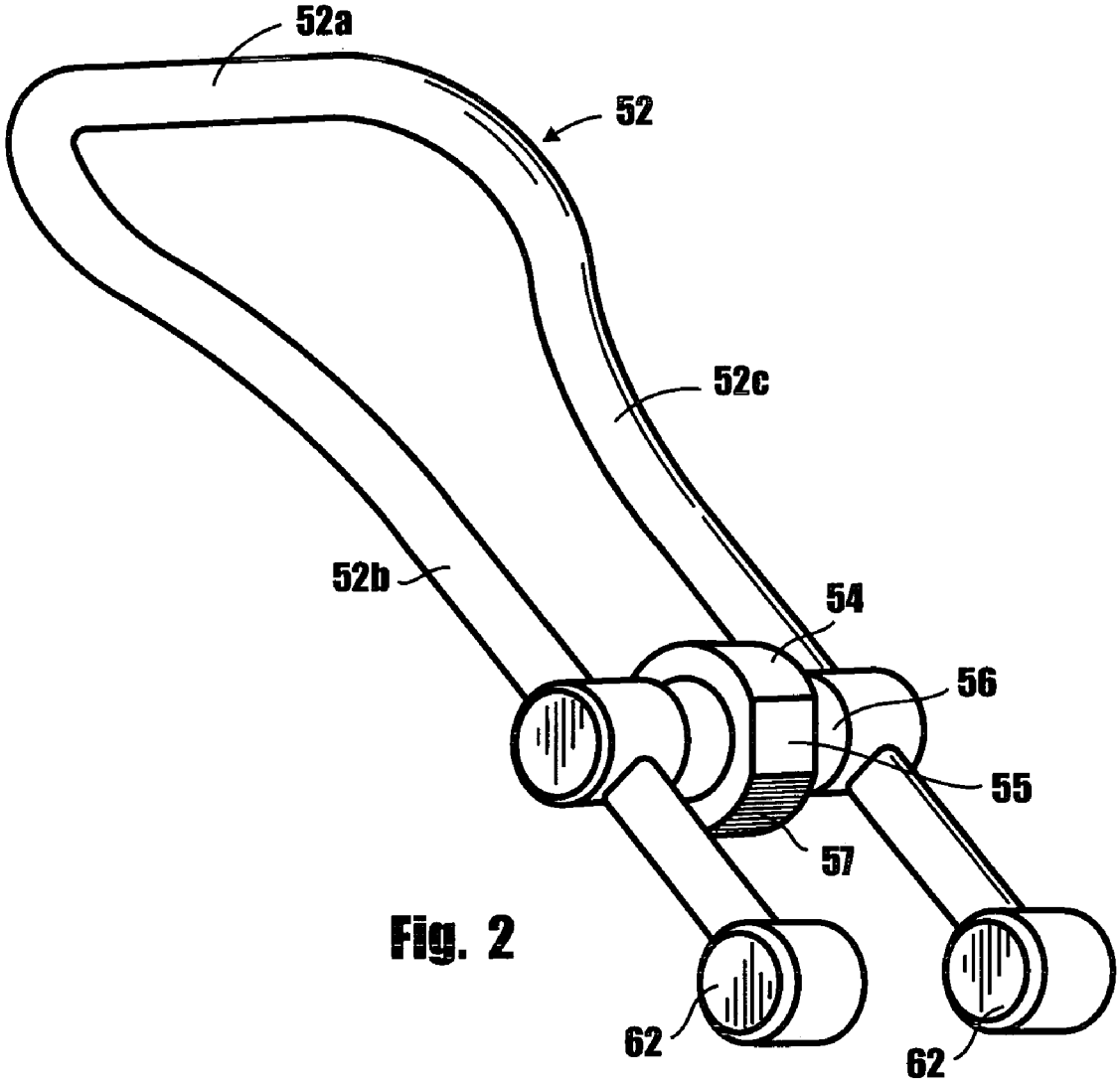
FIG. 2 is a generally perspective view of one form of the handle assembly of the invention for moving the carriage of the device upwardly and downwardly.

As best seen by referring to FIG. 2, handle assembly 52 includes a generally yoke-shaped handle 52 having a bight portion 52*a* and spaced-apart leg portions 52*b* and 52*c*. A drive drum 54 is connected to the central portion of a spanner member 56, which spans legs 52*b* and 52*c*. As illustrated in FIG. 2, drive or roller drum 54 is provided with a flat portion 55 and with a multiplicity of drive teeth 57, which, in a manner presently to be described, are engageable with a multiplicity of driven teeth 59 provided on surface 26*a* of guide 26 (FIG. 4) when the handle assembly is moved toward the second position shown by the dotted lines in FIG. 3. To assist in gripping the handle assembly, the bight portion and a portion of the spaced-apart legs of the handle are covered by an elastomeric gripping sleeve 60 (FIG. 1). Provided proximate the extremities of legs 52*b* and 52*c* (FIG. 2) are counterweights 62 which function to continuously urge the handle assembly into the upraised, starting position shown by the solid lines in FIG. 3.

Referring particularly to FIGS. 1 and 6 of the drawings, disposed within carriage 32 is a box-like clutch housing 64. Clutch housing 64, which is positioned within the interior space 34 of carriage 30 in the manner indicated in FIGS. 1 and 3, functions to interconnect the rotating means of the invention with the carriage. More specifically, as illustrated in FIG. 6, clutch housing 64 is provided with a central chamber 66 having a clutch engaging sidewall 66*a*, the purpose of which will presently be described.

Forming an important aspect of the jar opening apparatus of the present invention is the provision of safety release means for preventing the exertion of undue forces on the jar lid during the lid opening operation. In the present form of the invention, this novel safety release means uniquely functions to permit counter rotation of helical drive screw when, in a manner presently to be described, a predetermined amount of rotational force is exerted on driven member 46 by drive screw 42.

Figure 9:
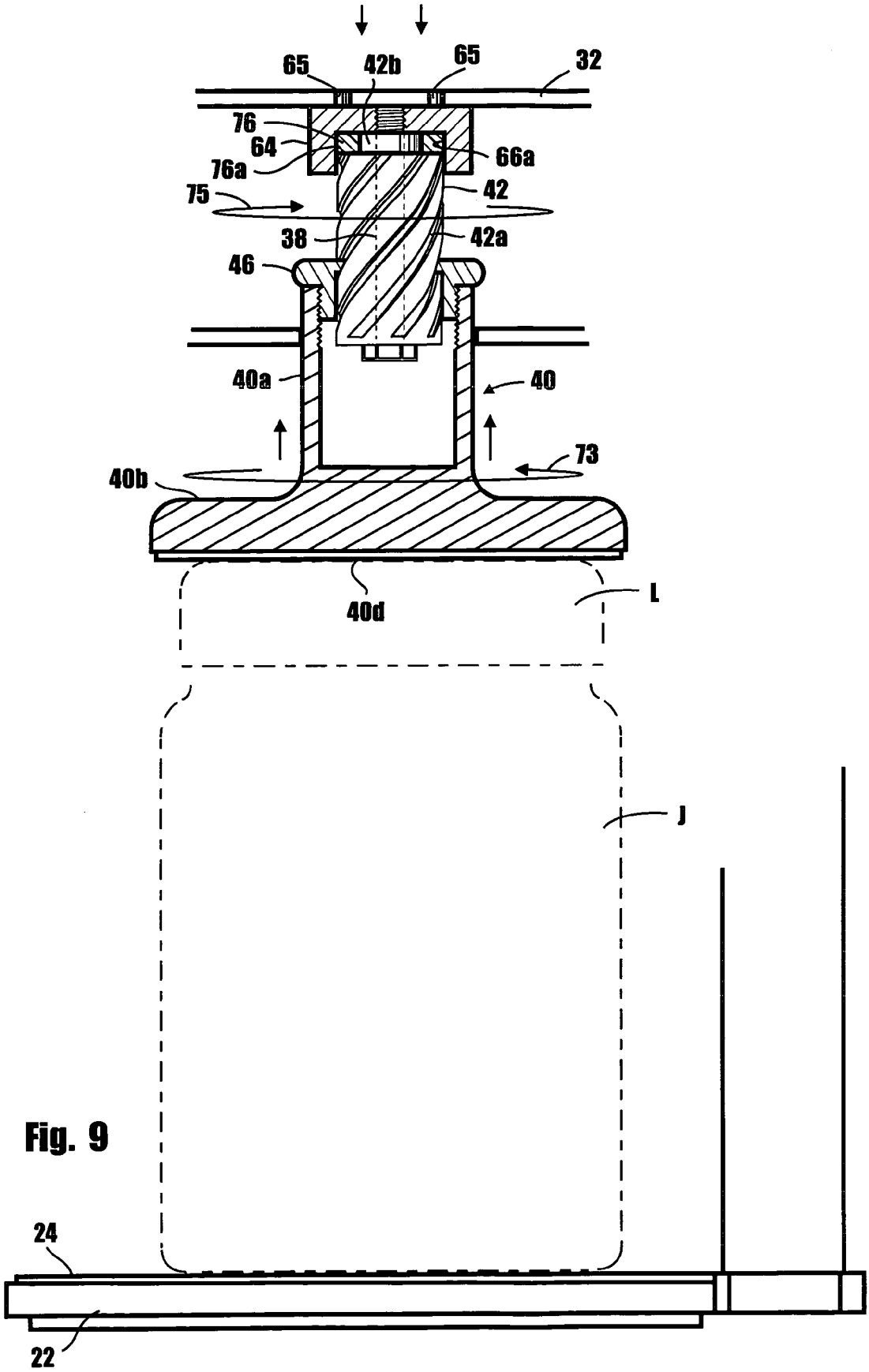
FIG. 9 is a cross-sectional view similar to FIG. 8, but showing the carriage assembly and helical drive shaft moved into a downward lid opening position.

In operating the device of the present form of the invention, with the various operating components interconnected in the manner shown in FIGS. 1, 8 and 9, and with the jar to be opened in position on base 22, the jar opening process can begin. It is to be observed that, when the handle assembly is in the upward position shown in FIG. 3, the flat 55 (FIG. 2) formed on roller drum 54 is disposed proximate guide surface 26*a* of guide 26. With the roller drum 54 in this position, the handle and carriage assemblies can move freely upwardly and downwardly along the guide column 26.

Figure 4:
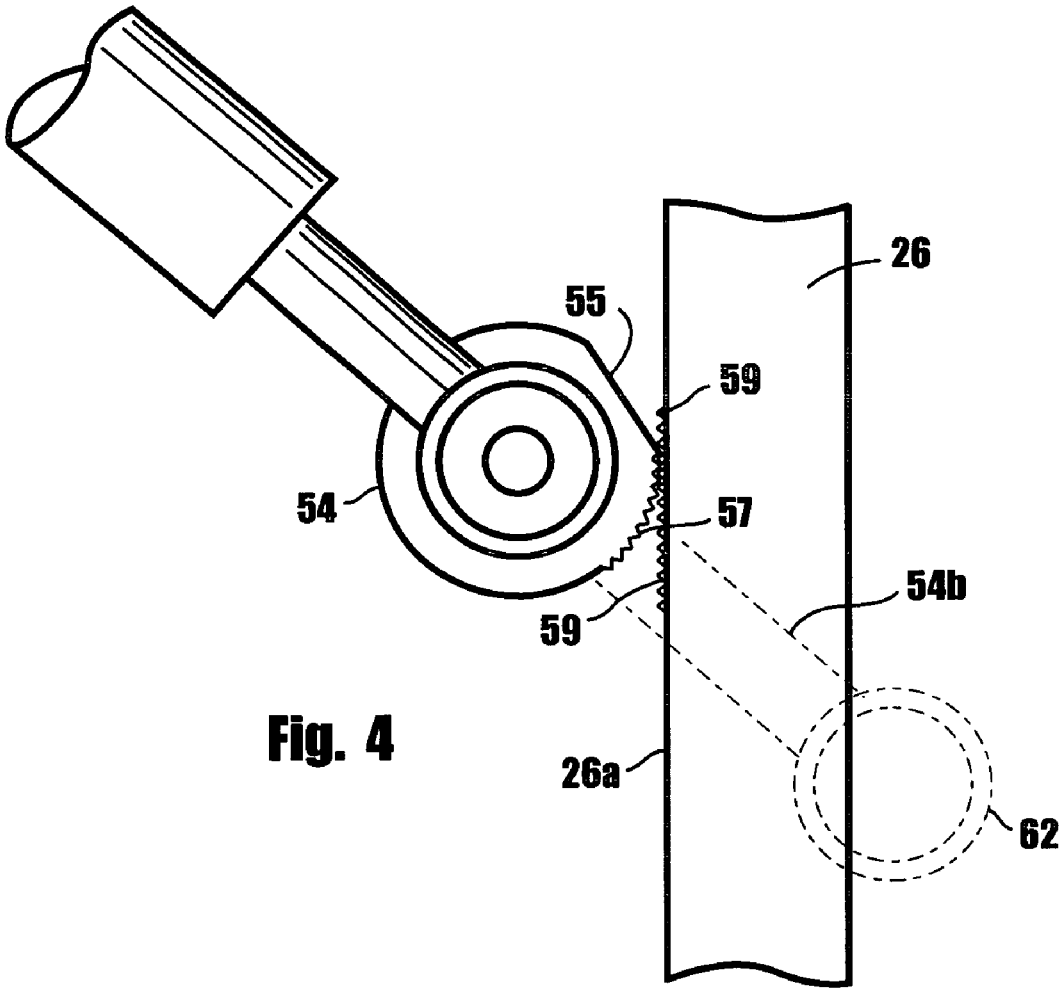
FIG. 4 is a fragmentary side view illustrating in greater detail the construction of the operating arm of the invention and the vertically extending guide column thereof.
Figure 5:
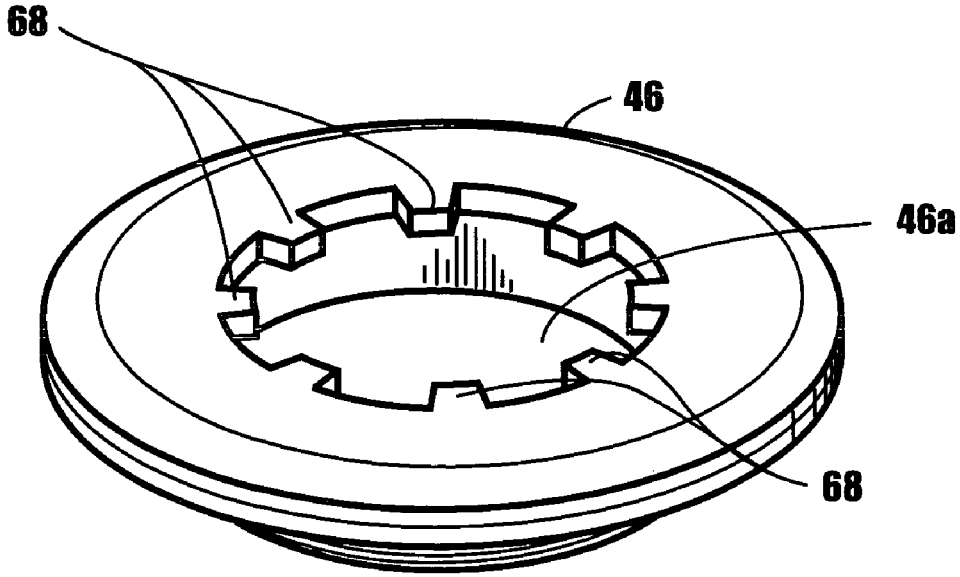
FIG. 5 is a generally perspective view of one form of the driven disc of the apparatus, which is driven by the helical drive shaft of the device.

With the flange portion 40*b* of the jar engaging assembly resting on the lid L of the jar to be opened, the exertion of a downward force on the handle assembly 52 in the manner indicated by the dotted lines in FIG. 3 will cause the handle assembly to pivot about the axis 56*a* of member 56 (FIGS. 2 and 3). As indicated in FIG. 4 of the drawings, this pivotal movement of the handle assembly will bring the multiplicity of drive teeth 57 formed on drive drum 54 into engagement with the multiplicity of driven teeth 59 formed on guide 26 (see FIG. 4) causing a downward movement of the carriage assembly 30. This downward movement of carriage assembly 30 will cause a downward movement of helical drive member 42 relative to driven member 46 from the position shown in FIG. 8 into the position shown in FIG. 9. Due to the cooperative interaction of the teeth 68 of driven member 46 with the helical groove 42*a* formed in helical drive member 42 within which the teeth 68 are received, this downward movement of the drive member will cause the driven member 46, along with lid-engaging member 40, to rotate in a counterclockwise direction as indicated by the arrow 73 of FIG. 3. This combination of a downward force and a simultaneous counterclockwise rotational force exerted on the jar lid will effortlessly loosen the jar lid permitting it to be easily removed from the jar.

As indicated by the arrow 75 of FIG. 9, at the same time a counterclockwise rotational force is exerted on driven member 46 a clockwise, or counter rotational force will be experienced by helical drive member 42. However, this clockwise rotational force experienced by the drive member will be resisted by the clutch means of the apparatus until such time as the downward, counterclockwise rotational force reaches a predetermined level.

In the present form of the invention, the novel clutch means comprises a friction clutch member 76 which is here provided in the form of a generally annular-shaped elastomeric friction member of the character best seen in FIG. 6. Clutch member 76 includes an outer friction surface 76*a* and an inner friction surface 76*b*. As indicated in FIG. 9 of the drawings, when the apparatus of the invention is fully assembled, outer friction surface 76*a* is disposed in frictional engagement with inner surface 66*a* of housing chamber 66 of the clutch housing 64, while inner surface 76*b* of the friction member is disposed in frictional engagement with a reduced diameter portion 42*b* formed on helical drive member 42. Clutch member 76 is strategically constructed so that it will effectively resist the tendency of the helical drive member 42 to rotate in a clockwise direction until such time as the combined downward and counterclockwise rotational forces being exerted on the lid-engaging assembly reach a level sufficient to risk crushing, breaking or otherwise damaging the jar being opened. Once such levels are reached, the frictional forces exerted by the clutch member 76 on the reduced diameter portion 42*b* of the helical drive member which resist clockwise rotation of the helical drive member, will be overcome, thereby permitting the helical drive member to rotate in a clockwise direction relative to the carriage assembly 30. This clockwise rotation of drive member 42 will immediately relieve the downward forces being exerted on the lid L by the handle assembly via the rotating means of the invention and will effectively prevent damage to the container being opened.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention.

I claim:

1. A jar opener for opening a jar having a screw-on lid comprising:

(a) a base having a jar supporting surface;

(b) a generally vertically extending guide connected to said base;

(c) a carriage assembly operably associated with said guide for movement relative to said guide between an elevated position and a lowered position, said carriage assembly comprising a carriage;

(d) a lid-engaging assembly operably associated with said carriage assembly for engaging the screw-on lid when said carriage is in said lowered position, said lid-engaging assembly including a lid-engaging member;

(e) rotating means operably associated with said lid-engaging member for rotating said lid-engaging member, said rotating means comprising a drive screw connected to said carriage and a driven member connected to said lid-engaging member, said drive screw comprising a helical drive screw and said driven member comprising a disk operably associated with said helical drive screw, said disk having a central aperture provided with a plurality of circumferentially spaced, driven teeth engageable with said helical drive screw; and (f) operating means operably associated with said carriage assembly for moving said carriage assembly between said lowered position and a lid compressing position to cause rotation of said lid by said rotating means.

2. The jar opener as defined in claim 1, further including safety release means carried by said carriage and operably associated with said helical drive screw for permitting rotation of said helical drive screw relative to said carriage.

3. The jar opener as defined in claim 2 in which said operating means comprises a handle assembly pivotally connected to said carriage assembly for movement between a first position and a second position, said handle assembly including a handle and a drive drum connected to said handle for engagement with said guide to move said carriage toward said lid compressing position when said handle assembly is moved toward said second position.

4. The jar opener as defined in claim 3 in which said guide is provided with a multiplicity of driven teeth and said drive drum is provided with a flat portion and with a multiplicity of drive teeth engageable with said driven teeth of said guide when said handle assembly is moved toward said second position.

5. The jar opener as defined in claim 3 in which said handle assembly includes counterweight means for urging said handle assembly toward said first position.

6. A jar opener for opening a jar having a screw-on lid comprising:

(a) a base having a jar supporting surface;

(b) a generally vertically extending guide connected to said base;

(c) a carriage assembly operably associated with said guide for movement relative to said guide between an elevated position and a lowered position, said carriage assembly comprising a carriage having an interior chamber;

(d) a lid-engaging assembly operably associated with said carriage for engaging the screw-on lid when said carriage is in said lowered position, said lid-engaging assembly including a lid-engaging member;

(e) rotating means operably associated with said lid-engaging member for rotating said lid-engaging member, said rotating means comprising a helical drive screw connected to said carriage and a driven member connected to said lid-engaging member, said drive screw having a helical groove and said driven member comprising a disk operably associated with said helical drive screw, said disk having a central aperture provided with a plurality of circumferentially spaced-apart driven teeth receivable within said helical groove of said helical drive screw; and (f) operating means operably associated with said carriage for moving said carriage between said lowered position and a lid compressing position to cause rotation of said lid by said rotating means, said operating means comprising a handle assembly pivotally connected to said carriage for movement between a first position and a second position, said handle assembly including a handle and a drive drum connected to said handle for engagement with said guide to move said carriage toward said lid compressing position when said handle assembly is moved toward said second position.

7. The jar opener as defined in claim 6 in which said guide is provided with a multiplicity of driven teeth and said drive drum is provided with a flat portion and with a multiplicity of drive teeth engageable with said driven teeth of said guide when said handle assembly is moved toward said second position.

8. The jar opener as defined in claim 6 in which said handle assembly includes counterweight means for urging said handle assembly toward said first position.

9. The jar opener as defined in claim 6 further comprising safety release means carried by said carriage and operably associated with said helical drive screw for permitting counter rotation of said helical drive screw relative to said carriage upon a predetermined rotational force being exerted on said lid-engaging member, said safety release means comprising a friction clutch member interconnected with said helical drive screw.

10. The jar opener as defined in claim 9 in which said carriage includes a clutch housing disposed within said interior chamber, said clutch housing having a clutch engaging surface for engaging said friction clutch member.

11. The jar opener as defined in claim 9 in which said friction clutch member comprises a generally annular-shaped member having an inner friction surface and an outer friction surface.

12. The jar opener as defined in claim 11 in which said outer friction surface of said friction clutch member frictionally engages said clutch engaging surface of said clutch housing.

13. The jar opener as defined in claim 12 in which said helical drive screw comprises a body portion having a reduced diameter portion having a surface engageable by said inner friction surface of said friction clutch member.

14. A jar opener for opening a jar having a screw-on lid comprising:

(a) a base having a jar supporting surface;

(b) a generally vertically extending guide connected to said base, said guide having a drum engaging face;

(c) a carriage assembly operably associated with said guide for movement relative to said guide between an elevated position and a lowered position, said carriage assembly comprising a carriage, including a clutch housing;

(d) a lid-engaging assembly operably associated with said carriage for engaging the screw-on lid when said carriage is in said lowered position, said lid-engaging assembly including a lid-engaging member;

(e) rotating means operably associated with said lid-engaging member for rotating said lid-engaging member, said rotating means comprising a helical drive screw connected to said carriage and a driven member connected to said lid-engaging member, said driven member comprising a disk connected to said lid-engaging member and operably associated with said helical drive screw, said disk having a central aperture provided with a plurality of circumferentially spaced-apart driven teeth engageable with said helical drive screw;

(f) operating means operably associated with said carriage for moving said carriage between said lowered position and a lid compressing position to cause rotation of said lid by said rotating means, said operating means comprising a handle assembly pivotally connected to said carriage for movement between a first position and a second position, said handle assembly including a handle and a drive drum connected to said handle for engagement with said guide to move said carriage toward said lid compressing position when said handle assembly is moved toward said second position; and (g) safety release means carried by said carriage and operably associated with said helical drive screw for permitting counter rotation of said helical drive screw when a predetermined rotational force is exerted on said drive screw.

15. The jar opener as defined in claim 14 in which said drum engaging face of said guide is provided with a multiplicity of driven teeth and said drive drum is provided with a flat portion and with a multiplicity of drive teeth engageable with said driven teeth of said guide when said handle assembly is moved toward said second position.

16. The jar opener as defined in claim 14 in which said clutch housing of said carriage includes a clutch engaging surface for engaging said friction clutch member.

17. The jar opener as defined in claim 16 in which said friction clutch member comprises a generally annular-shaped elastomeric member having an inner friction surface and an outer friction surface.

18. The jar opener as defined in claim 17 in which said outer friction surface of said friction clutch member frictionally engages said clutch engaging surface of said clutch housing.

19. The jar opener as defined in claim 18 in which said helical drive screw comprises a body portion having a helical groove and a reduced diameter portion having a surface engageable by said inner friction surface of said friction clutch member.

* * * * *